United States Patent [19]

Reithel

[11] 4,201,583

[45] May 6, 1980

[54] ELECTRICALLY ACTIVATED RECORDING MATERIAL AND PROCESS

[75] Inventor: Raymond F. Reithel, Rochester, N.Y.

[73] Assignee: Eastman Kodak Company, Rochester, N.Y.

[21] Appl. No.: 961,819

[22] Filed: Nov. 17, 1978

Related U.S. Application Data

[62] Division of Ser. No. 858,780, Dec. 8, 1977.

[51] Int. Cl.[2] ..... G03C 5/00

[52] U.S. Cl. ..... 430/97; 430/350; 430/619; 430/336

[58] Field of Search ..... 96/48 HD, 114.1, 1.5, 96/68

[56] References Cited

U.S. PATENT DOCUMENTS

| | | | |
|---|---|---|---|
| 3,287,115 | 11/1966 | Hoegl | 96/1 |
| 3,894,868 | 7/1975 | Regensberger | 96/1.5 |

*Primary Examiner*—John D. Welsh
*Attorney, Agent, or Firm*—Richard E. Knapp

[57] ABSTRACT

A photographic speed-increasing concentration of a certain organic photographic speed-increasing electron acceptor provides increased photographic speed in a charge-sensitive recording composite material having an ohmic resistivity of at least about $1\times10^{10}$ ohm-cm. The charge-sensitive recording material can comprise (a) a first electrically conducting layer in association with (b) a photoconductor layer, (c) an electrically activated recording layer comprising an image-forming combination of (i) an organic, heavy metal salt oxidizing agent with (ii) a reducing agent and (iii) the described speed-increasing electron acceptor, and a binder, and (d) a second electrical conducting layer. This recording material can be room light handleable and can provide a developed image with increased speed by dry development subsequent to electrical exposure.

16 Claims, 5 Drawing Figures

LATENT IMAGE FORMATION

HEAT DEVELOPMENT

LATENT IMAGE FORMATION

FIG. 4
HEAT DEVELOPMENT
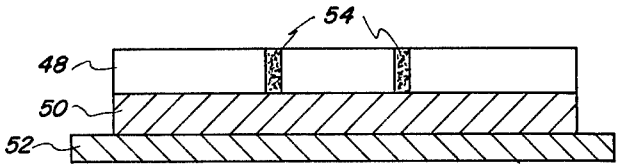
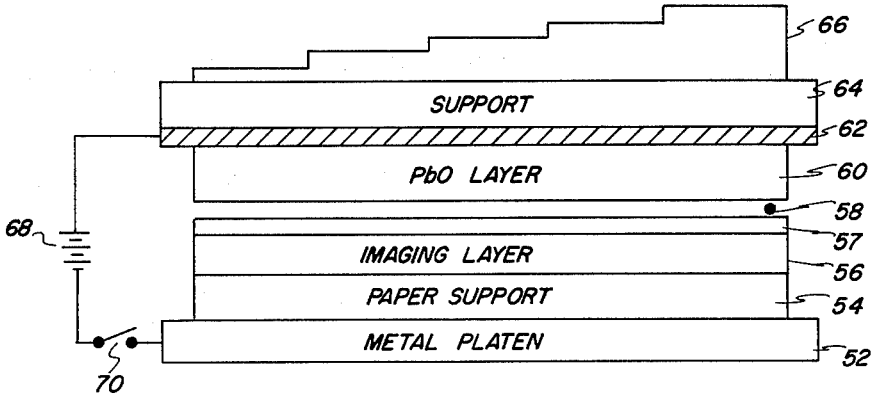
FIG. 5

ELECTRICALLY ACTIVATED RECORDING MATERIAL AND PROCESS

This is a division of application Ser. No. 858,780, filed Dec. 8, 1977.

BACKGROUND OF THE INVENTION

1. Field of the Invention

This invention relates to an improved charge-sensitive recording material having certain ohmic resistivity and providing increased speed. It also relates to a process for providing development of a latent image in the described charge-sensitive recording material. One aspect of the invention relates to use of an electrically activated recording layer comprising a particular image-forming combination with specific speed-increasing electron acceptors to provide a developable latent image.

2. Description of the State of the Art

A variety of recording materials and processes have been proposed and developed to provide image recording. The better known and commercially more successful of these recording materials and processes can be classified as being photographic, thermographic or electrographic or as being a combination of two or more of these. For example, one recording material which is known is a photothermographic material which is a heat developable, photographic material designed for imaging by what has been described as dry processing with heat. Each of the known image recording materials and processes has certain advantages for particular uses; but, the materials and processes also suffer from disadvantages which limit the usefulness in other applications. For example, conventional photographic materials have the disadvantage that they are not room light handleable prior to imagewise exposure and processing. Thermographic materials require imagewise heating to provide a visible image and are not capable of the degree of light sensitivity provided by conventional photographic materials and photothermographic materials. Electrographic materials including, for example, xerographic materials require a mechanical dust pattern transfer procedure in order to provide a desired image.

It has been desirable to provide an image-recording material and process which enable the image density of a developed silver image with increased speed while avoiding the expense of conventional photosensitive silver halide materials and at the same time (1) avoiding the need for conventional processing baths and solutions and (2) enabling room light handling of the imaging material prior to imagewise exposure.

Heat developable photographic materials, or photothermographic materials, which after imagewise exposure can be heated to provide a developed image in the absence of processing solutions or baths are known. These photosensitive materials have the disadvantage that they are not room light handeable prior to imagewise exposure for recording purposes.

Dry electrographic recording materials and processes for the production of a visible image in a charge-sensitive recording element have been described in French Patent No. 2,280,517 published Feb. 27, 1976. These dry electrographic recording materials and processes provide certain advantages, for instance, the use of light handeable materials prior to imagewise exposure. A continuing need has existed, however, to provide increased speed in such materials to provide a developed image within shorter exposure time. This shorter exposure time is especially important, for instance, in X-ray imaging. Shorter X-ray exposure time in X-ray imaging of parts of the human body, for instance, can reduce risk of damage to body tissue.

Other dry electrographic recording materials and processes are also known, such as described in U.S. Pat. No. 3,978,335 of Gibbons, issued Aug. 31, 1976. These materials and processes are satisfactory for many purposes in X-ray imaging. A speed-increasing component which provides at least two times the speed of the described materials would be very useful in these materials. This could expand the purposes and usefulness of the described materials and processes.

Non-silver dry electrographic recording materials and processes have also been proposed as described in copending U.S. Application Ser. No. 783,577 of Lelental and Gysling, filed Apr. 1, 1977. These non-silver electrographic recording materials and processes can provide a visible non-silver image in a charge-sensitive recording element. However, a need has also existed for increased speed in these non-silver electrographic recording materials and processes.

There has also been a continuing need to provide improved tellurium-containing, heat-developable imaging materials and processes in which illumination of silver in the image-recording material provides increased speed to the tellurium-containing material. This continuing need has been especially true for tellurium-containing, heat developable materials which enable amplification of a nuclei image.

A further particular need has continued for an imaging material, preferably a non-silver imaging material, which is room light handleable and suitable for providing increased speed for radiography, such as medical radiography. In this use it is important that as little X-ray radiation as possible be used for imaging. The recording material therefore must be capable of forming a latent image with a significantly low charge density upon brief X-ray exposure. The conventional silver halide photographic materials useful for medical radiography have provided a high degree of photosensitivity but have the disadvantage of not being room light handleable. Conventional commercial X-ray sensitive silver halide photographic materials also have been processed using processing solutions or baths, rather than dry processing.

Accordingly, there has been a continuing need for improved dry electrographic recording materials and processes which enable room light handleable imaging, ohmic resistivity within desired ranges, imaging that enables latent image amplification with improved speed, and dry processing.

SUMMARY OF THE INVENTION

It has been found according to the invention that the described combination of advantages is provided by a charge-sensitive recording element having an ohmic resistivity of at least about $1\times10^{10}$ohm-cm comprising, in sequence, a support having thereon (a) a first electrical conducting layer, (b) a photoconductor layer, (c) an electrically activated recording layer comprising an image-forming combination of (i) an organic, heavy metal salt oxidizing agent, and (ii) a reducing agent, and (d) a second electrical conducting layer, wherein the electrically activated recording layer comprises a photographic speed-increasing concentration of a certain organic, photographic speed-increasing electron acceptor. The speed-increasing concentration of the organic, photographic speed-increasing electron acceptor provides an increase in speed compared to a control, as described herein, containing no such electron acceptor. Increase in speed, which is preferably at least two times that of the control, as described, is measured at the mid-point between maximum and minimum density on a sensitometric curve for an image having a developed image density of at least 1.0.

A particularly useful charge-sensitive composite recording element according to the invention is one having an ohmic resistivity of at least about $1\times10^{10}$ ohm-cm and comprising, in sequence, a support having thereon components (a), (b), (c) and (d), as described, and wherein the photographic speed-increasing electron acceptor is a compound selected from the group consisting of (I) anthraquinone and substituted anthraquinone electron acceptors, (II) phthalaldehyde, (III) tetrachlorophthalonitrile, (IV) tetrachlorophthalic anhydride, (V) p-chloranil, (VI) $\alpha,\alpha,\alpha,\alpha',\alpha',\alpha'$-hexachloro-p-xylene, and (VII) cobaltihexamine trifluoroacetate and combinations thereof.

It has also been found that advantages are provided by a charge-sensitive, electrically activated recording composition comprising (A) an oxidation-reduction image-forming combination comprising (i) an organic silver salt oxidizing agent, with (ii) a reducing agent selected from the group consisting of 3-pyrazolidone, phenolic, reductone, and sulfonamidophenol reducing agents, and (B) a photographic speed-increasing concentration of an organic photographic speed-increasing electron acceptor which consists essentially of a compound selected from the group consisting of (I) anthraquinone and substituted anthraquinone electron acceptors (II) phthalaldehyde, (III) tetrachlorophthalonitrile, (IV) tetrachlorophthalic anhydride, (V) p-chloranil, (VI) $\alpha,\alpha,\alpha,\alpha',\alpha',\alpha'$-hexachloro-p-xylene, (VII) cobaltihexamine trifluoroacetate, and combinations thereof, and a synthetic polymeric binder.

A dry electrically activated recording process according to the invention for producing a developed, silver image in a charge-sensitive recording element having an ohmic resistivity of at least about $1\times10^{10}$ and containing at least one electrically activated recording, image-forming combination comprising (i) an organic, silver salt oxidizing agent with (ii) an organic reducing agent, and (iii) a photographic speed-increasing concentration of an organic photographic speed-increasing electron acceptor which is a compound selected from the group consisting of (I) anthraquinone and substituted anthraquinone electron acceptors, (II) phthalaldehyde, (III) tetrachlorophthalonitrile, (IV) tetrachlorophthalic anhydride, (V) p-chloranil, (VI) $\alpha,\alpha,\alpha,\alpha',\alpha',\alpha'$-hexachloro-p-xylene, (VII) cobaltihexamine trifluoroacetate, and combinations thereof, and a binder; comprises the steps of (A) imagewise applying an electrical potential across said recording layer of a magnitude and for a sufficient time to produce a developable latent image in said layer corresponding to said image (I); and, (B) heating said recording layer substantially uniformly at a temperature and for a time sufficient to develop said latent image. For example, step (A) in the described process can comprise applying an electric potential imagewise to the described recording element, not containing a photoconductor layer, of a magnitude and for a sufficient time to produce in the image areas a charge density within the range of about 0.1 microcoulomb/cm$^2$ to about 1 millicoulomb/cm$^2$, wherein the charge density forms a developable latent image in the recording element.

A developed image, especially a developed silver image in a charge-sensitive recording element containing a photoconductor layer, as described, can be provided by the steps of, for example, (A) imagewise altering the conductivity of the described photoconductor layer in accord with an image (I) to be recorded; (B) applying an electrical potential across the photoconductive and recording layers of a magnitude and for a sufficient time to produce a developable latent image in the layer corresponding to the image (I); and (C) heating the described recording layer substantially uniformly at a temperature and for a time sufficient to develop the latent image.

Other dry, electrically activated recording processes embodying the concept of the invention and use of the described image-forming combination comprising the described speed-increasing electron acceptors can be useful as described herein. For example, the process can include formation of an image using modulation of a corona ion current flow to the recording element with an electrostatic field established imagewise between (1) an image grid comprising an electroconductive core sequentially connectable to sources of different potential relative to the recording material and covered with a coating of a photoconductive insulating material and (2) a control grid that is electrically conductive and sequentially connectable to sources of different potential relative to the recording element.

BRIEF DESCRIPTION OF THE DRAWINGS

FIGS. 3 and 4 illustrates schematically another recording process embodying the described invention.

FIG. 5 illustrates schematically an especially useful image-recording material that is an illustrative embodiment of the invention.

DETAILED DESCRIPTION OF THE INVENTION

Figure 1:
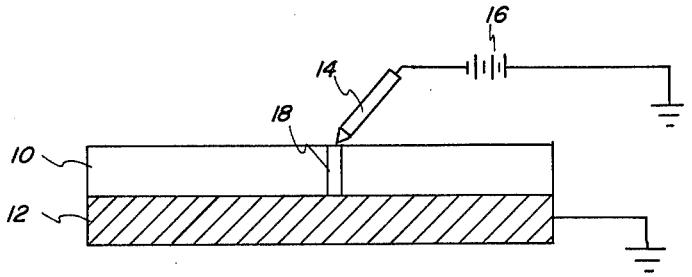
FIGS. 1 and 2 illustrates schematically an image-recording material and process according to one illustrative embodiment of the invention.

A variety of materials is useful in the described electrically activated recording material and processes according to the invention. The exact mechanism by which the latent image is formed in the recording material and the exact mechanism by which the described speed-increasing electron acceptors provide the desired increased speed are not fully understood. It is postulated that the injection of an electron due to the electric field into the reducible, organic, heavy metal salt oxidizing agent results in the formation of the described developable latent image. It is believed that development of the latent image is accomplished by a reaction in the recording material whereby the metal from the organic heavy metal salt oxidizing agent is provided on the latent image site by a physical development mechanism involving the reaction between the described reducing agent and the organic, heavy metal salt oxidizing agent. It is neither entirely clear why the electron acceptor provides the desired increased speed, nor why the covering power provided by such a combination is as high or higher than the covering power provided from a similar composition in the absence of the described electron acceptor.

While a variety of image-recording combinations containing the described electron acceptors is useful, the optimum image-recording combination and image-recording element will depend upon such factors as the desired image, the particular image-forming combination, the particular speed-increasing electron acceptor, the source of activating electrical energy, processing condition ranges and the like.

The term "charge-sensitive recording material" as used herein is intended to mean a material which when subjected to an electrical current undergoes a chemical and/or electrical change which provides a developable latent image.

The term "latent image" as used herein is intended to mean an invisible or faintly visible image that is capable of amplification in a subsequent processing step, especially in a subsequent heat development step.

The term "resistive recording material" as used herein is intended to mean a material that has an ohmic resistivity of at least about $1\times10^{10}$ohm-cm.

The term "dry binder" as used herein is intended to mean a polymeric material that is dry to the touch under normal atmospheric conditions. The polymer can contain a small percentage of water.

A variety of organic, photographic speed-increasing electron acceptors is useful in the described electrically activated recording material of the charge-sensitive recording element according to the invention. A simple test can be useful for selecting an organic, photographic speed-increasing electron acceptor. While different tests are useful for such a selection, one test consists of adding a proposed organic, photographic speed-increasing electron acceptor to a particular charge-sensitive recording element to determine if the speed-increasing electron acceptor provides an increase in speed of at least two times that of a control containing no such electron acceptor. Increase in speed as described is measured at the mid-point between maximum and minimum density in a suitable sensitometric curve for an image having a developed image density of at least 1.0. The proposed organic, photographic speed-increasing electron acceptor is considered satisfactory if the electron acceptor provides an increase in speed, preferably of at least two times, compared with a control containing no such electron acceptor in the following test: (I) a charge-sensitive recording element comprising, in sequence, a transparent film support that can withstand the processing temperatures to be used, such as a poly(ethylene terephthalate) film support, having thereon (i) a first electrically conductive layer, typically a nickel layer, (ii) a lead monoxide photoconductor layer comprising a polymer binder, such as a styrene-butadiene copolymer binder, (iii) an electrically activated recording layer comprising an image-forming combination comprising (IA) a silver behenate oxidizing agent, with (IIA) a 2,2'-methylenebis(6-tertiarybutyl-4-methylphenol) reducing agent, and a poly(vinyl butyral) binder, a 1(2H)-phthalazinone toner, malic acid, and 0.02 to 0.06 mole of the organic, photographic speed-increasing electron acceptor per mole of silver, (iv) an electrically conductive layer, typically a Cr-SiO cermet layer is imagewise exposed to tungsten light at an intensity that can provide a developed density of 1.0, typically an intensity of 15 foot candle seconds, while passing a direct electric current between the described layer (iv) and the described layer (i) through layers (ii) and (iii) at a voltage of 3 kilovolts; and then, (II) separating the described layer (iii) and heating it to 110°C. for a sufficient time to provide a developed image density of at least 1.0. Examples of useful compounds which satisfy this test include described compounds (I), (II), (III), (IV), (V), (VI) and (VII). Especially useful speed-increasing electron acceptors are anthraquinone and substituted anthraquinone electron acceptors.

The optimum photographic speed-increasing concentration of the described organic, photographic speed-increasing electron acceptor will vary depending upon such factors as the desired image, the particular image-forming combination, the processing condition ranges, the particular electron acceptor and the like. Typically, a charge-sensitive recording element according to the invention comprises about 0.001 to about 0.005 moles of the described oxidizing agent, about 0.0008 to about 0.004 moles of the described reducing agent and a photographic speed-increasing concentration of the described electron acceptor that is within the range of about $10^{-5}$ to about $10^{-3}$ moles of the electron acceptor per square meter of the support of the charge-sensitive recording element based on dry binder. In most instances, the photographic speed-increasing concentration of the organic, photographic speed-increasing electron acceptor will be within the range of about 0.02 to about 0.06 mole of the electron acceptor per mole of the described oxidizing agent in the electrically activated recording layer.

The described charge-sensitive recording materials of the invention are versatile as well as simple for image recording. For instance, various devices and means are useful to regulate the current flow in the recording material including, for example, an electrostatically charged stencil, stylus or screen, or a suitable photoconductive layer contiguous to the image-forming layer of the charge-sensitive material. When a photoconductor is used, any source of radiation of which the photoconductor is responsive can be useful as the imagewise exposure sources, provided that the dynamic resistance of the photoconductor closely matches the dynamic resistance of the recording material in the operating voltage range as described in the invention.

The charge-sensitive recording composite element according to the invention can comprise one or more of the described organic, heavy metal salt oxidizing agents in the electrically activated recording layer. For example, the described recording layer can comprise an organic, heavy metal salt oxidizing agent that is a silver salt oxidizing agent such as a silver salt of a long-chain fatty acid, such as a silver salt of a fatty acid containing 17 to 30 carbon atoms. Such silver salt oxidizing agents are typically resistant to darkening upon illumination. Typically useful silver salt oxidizing agents include, for example, silver behenate, silver sterarate, silver oleate, silver laurate, silver hydroxystearate, silver caprate, silver myristate, and silver palmitate. Silver salts which are not silver salts of long-chain fatty acids can be useful also. Such silver salt oxidizing agents include, for example, silver benzotriazole, silver benzoate, silver terephthalate, silver imidazole, and the like. Examples of other organic heavy metal salt oxidizing agents that are not silver salt oxidizing agents are gold stearate, mercury behenate, gold behenate and copper salts. Organic, heavy metal salt oxidizing agents that are not silver salts can also be useful in the described electrically activated recording layer. Examples of organic, non-silver heavy metal salt oxidizing agents include tellurium di(butyl xanthate), tellurium bis(isopropyl xanthate), and other tellurium (II) coordination complexes of tellurium with bidentate, sulfur-containing, univalent anions such as dithiocarbamate, thioxanthate, dithioacid, dithiophosphinate, difluorodithiophosphinate, dithiophosphate and dithiocarbimate ligands. These tellurium (II) coordination complexes are described, for example, in copending U.S. Application Ser. No. 783,577 of Lelental and Gysling, filed Apr. 1, 1977, the description of which is enclosed herein by reference. Combinations of the described organic, heavy metal salt oxidizing agents can also be useful in the described electrically activated recording layer.

Selection of an optimum organic, heavy metal saltoxidizing agent or combination of such oxidizing agent will depend upon such factors as the desired image, the particular image-forming combination, the source of activating electrical energy, processing condition ranges and the like. An especially useful organic heavy metal salt oxidizing agents is silver behenate.

A range of concentration of the described organic, heavy metal salt oxidizing agent is useful in the described electrically activated recording layer. The optimum concentration of the organic heavy metal salt oxidizing agent will depend upon the described factors such as the desired image, the particular image-forming combination, the source of activating electrical energy, the particular reducing agent, processing conditions and the like. A typically useful concentration of organic heavy metal salt oxidizing agent is within the range of about $10^{-3}$ to about $5\times10^{-3}$ moles of the oxidizing agent per square meter of the support of the charge-sensitive recording element based on dry binder present.

The terms "salt" and "complex" as used herein regarding the organic, heavy metal salt oxidizing agent are intended to include any type of bonding or complexing mechanism that enables the resulting described oxidizing agent to provide the necessary oxidizing agent properties in the image-forming combination in the electrically activated recording layer. In some instances the exact bonding of the described "salt" and "complex" is not fully understood. The terms are intended to include salts and other forms of bonding that enable the desired image-forming combination to provide a latent image as well as image amplification as described. The terms "salt" and "complex" also are intended to include neutral complexes and salts of non-neutral complexes.

The described charge-sensitive recording composite element according to the invention can comprise a variety of reducing agents. These reducing agents can be organic reducing agents or inorganic reducing agents or combinations of reducing agents. Reducing agents which are useful are typically silver halide developing agents. Examples of useful reducing agents include phenolic compounds such as polyhydroxybenzenes, including hydroquinone, alkyl-substituted hydroquinones, such as tertiarybutyl hydroquinone, methyl hydroquinone, 2,5-dimethyl hydroquinone and 2,6-dimethyl hydroquinone; catechols and pyrogallols; chloro-substituted hydroquinones such as chlorohydroquinone or dichlorohydroquinone; alkoxy substituted hydroquinones such as methoxy hydroquinone or ethoxy hydroquinone; aminophenol reducing agents such as 2,4-diaminophenols and methylaminophenols; ascorbic acid reducing agents such as ascorbic acid and ascorbic acid derivatives; hydroxylamine reducing agents; 3-pyrazolidone reducing agents such as 1-pheyl-3-pyrazolidone and 4-methyl-4-hydroxymethyl-1-phenyl-3-pyrazolidone; reductone reducing agents such as 2-hydroxy-5-methyl-3-piperidino-2-cyclopentanone; sulfonamidophenol reducing agents and the like. Combinations of reducing agents can be especially useful.

Selection of an optimum reducing agents or reducing agent combination in a charge-sensitive recording material according to the invention will depend upon such factors as the particular image-forming combination, processing conditions, the particular electrical energy source, the particular speed-increasing electron acceptor, other components of the composite element and the like.

A range of concentration of the described reducing agent or reducing agent combination is useful in the composite element according to the invention. The optimum concentration of reducing agent or reducing agent combination in the recording element will depend upon the described factors such as the particular image-forming combination, thedesired image, processing conditions and the like. Typically, a useful concentration of the described reducing agent or reducing agent combinaton is within the range of about 0.3 to about 1.5 moles of reducing agent or reducing agent combination per mole of the described organic, heavy metal salt oxidizing agent in the electrically activated recording layer. For example, the concentration of reducing agent can be within the range of about 0.5 to about 1.0mole of reducing agent per mole of the described heavy metal salt oxidizing agent in the electrically activated recording layer.

As especially useful embodiment of the invention is a charge-sensitive recording element, as described, wherein the reducing agent is selected from the group consisting of 3-pyrazolidione, phenolic, reductone and sulfonamidophenol reducing agents and combinations thereof as described. Typical reducing agents which are useful according to the invention are p-benzenesulfonamidophenol, 2,6-dichlorobenzenesulfonamidophenol and alkylene bisphenol reducing agents such as 2,2'-methylenebis(6-tertiarybutyl-4-methylphenol).

It is important that the reducing agent or reducing agent combination selected not adversely affect and not be adversely affected by the charge sensitivity and ohmic resistivity of the described element according to the invention.

While it is often not necessary or desirable in a charge-sensitive recording element according to the invention, the photosensitive component can also be present in the element if desired. This photosensitive component can be any photosensitive material, such as a salt or complex, which provides developable nuclei upon charge exposure according to the invention. If a photosensitive component is employed, an especially useful photosensitive metal salt is photosensitive silver halide due to its high degree of light sensitivity. A typical concentration of photosensitive metal salt is within the range of about 0.0001 to about 10.0 moles of photosensitive metal salt per mole of the described organic, heavy metal salt oxidizing agent in the described charge-sensitive recording element. For example, a typical concentration range of photosensitive silver halide, when such a photosensitive component is employed, is within the range of about 0.001 to about 2.0 moles of photosensitive silver halide per mole of described organic, heavy metal salt oxidizing agent. Other photosensitive materials can be present in the described element according to the invention. When a photosensitive silver halide is employed, a preferred photosensitive silver halide is silver chloride, silver bromide, silver bromoiodide, silver chlorobromoiodide or mixtures thereof. For purposes of the invention, silver iodide is also considered to be a photosensitive silver halide. The photographic silver halide can be prepared by methods and in a variety of forms known in the photographic art.

Such procedures and forms of photographic silver halide are described, for example, in the *Product Licensing Index*, Volume 92, December 1971, publication 9232 on page 107, paragraph I, published by Industrial Opportunities Ltds., Homewell, Havant Hampshire, PO9 1EF, UK. The photographic silver halide can be washed or unwashed, can be chemically sensitized using chemical sensitization procedures known in the photographic art, can be protected against the production of fog and stabilized against loss of sensitivity during keeping as described in the above *Product Licensing Index* publication.

If a photosensitive component is employed in the described element according to the invention, the described image-forming combination in the electrically activated recording layer can enable the concentration of the photosensitive metal salt to be lower tha normally would be expected in a photosensitive element. This lower concentration is enabled by the amplification effect of the image-forming combination, as described as well as the formation of developable nuclei as described. In some instances the concentration of photosensitive component can be sufficiently low that after imagewise exposure and development of the photosensitive component alone, in the absence of other of the described components, the developed image is not visible.

While in many cases it is not necessary and not desirable, a stabilizer or stabilizer precursor for post-processing stabilization of the developed image in the described element according to the invention can be used. In some cases the described organic, heavy metal salt oxidizing agent and the developed image are sufficiently stable after processing that use of a stabilizer or stabilizer precursor can be avoided. However, in the case of materials which contain photosensitive components, especially photosensitive silver halide, it can be desirable to include such a stabilizer or stabilizer precursor to help avoid post-processing printout. A variety of stabilizer or stabilizer precursors can be useful in such elements according to the invention. These stabilizers or stabilizer precursors can be useful alone or in combination if desired. Selection of an optimum stabilizer or stabilizer precursor will depend upon the described factors such as the desired image particular components of the electrically activated recording layer, processing conditions and the like. Typically, stabilizers or stabilizer precursors can be selected from, for example, photolytically activated polybromated organic compounds such as described in U.S. Pat No. 3,874,946 for Costa et al., issued Apr. 1, 1975 and thio and thione stabilizer precursors such as described in Belgian Patent No. 768,071 issued July 30, 1971 and U.S. Pat. No. 3,893,859 of Burness et al., issued July 8, 1975.

When a stabilizer or stabilizer precursor is emloyed in an element according to the invention, a range of concentration of stabilizer or stabilizer precursor or combinaton of stabilizer or stabilizer precursors can be useful. An optimum concentration of stabilizer or stabilizer precursor or combinaton of stabilizer or stabilizer precursors will depend upon such factors as the particular element, processing conditions, particular stabilizer or stabilizer precursor, desired stability of the developed image, and the like.

The described element according to the invention can contain a variety of colloids and polymers alone or in combination as vehicles, binding agents, and in various layers. Suitable materials can be hydrophobic or hydrophilic. It is necessary, however, that the colloid and polymers used in the element not adversely affect the charge sensitivity or ohmic resistivity of the described element of the invention. Accordingly, the selection of an optimum colloid and polymer or combination of colloids and polymers, will depend upon such factors as the desired charge sensitivity, desired ohmic resistivity, particular desired image, particular processing conditions, particular components in the electrically activated recording layer and the like. Useful materials can be transparent or translucent and include both naturally-occurring substances such as proteins, for example, gelatin, gelatin derivatives, cellulose derivatives, polysaccharides, such as dextran, gum arabic and the like. Synthetic polymeric substances, however, are preferred due to their desired charge sensitivity properties and ohmic resistivity properties. Useful polymeric materials for this purpose include, for instance, polyvinyl compounds, such as poly(vinyl pyrrolidone), acrylamide polymers, and dispersed vinyl compounds such as in latex form, particularly those which increase dimensional stability of the charge-sensitive element. Useful polymers include water insoluble polymers of alkyl acrylates and methacrylates, acrylic acid, sulfoalkyl acrylates, methacrylates, and those which have cross-linking sites which facilitate hardening or curing. Especially useful polymers are high molecular weight materials and resins which are compatible with the described components of the electrically activated recording layer. These include, for example, poly(vinyl butyral), poly(vinyl formal), cellulose acetate butyrate, poly(methyl methacrylate), poly(vinyl pyrrolidone), ethyl cellulose, polystyrene, poly(vinyl chloride), poly(isobutylene), butadiene-styrene copolymers, vinyl chloride-vinyl acetate copolymers, copolymers of vinyl acetate, vinyl chloride and maleic acid, and poly(vinyl alcohol). Combinations of the described colloids and polymers can also be useful depending upon the described factors.

A range of concentration of the described colloids or polymers can be useful in the described recording element according to the invention. The optimum concentration of colloid or polymer or combination of colloids or polymers will depend upon the described factors such as the particular electrically activated recording layer, processing conditions, desired image, and the like. While the electrically activated recording layer, in some instances, need not contain a separate binder, in most cases the electrically activated recording layer does contain a concentration of binder, especially a synthetic polymeric binder. The concentration of binder is typically within the range of about 0.4 g to about 1.2 g of polymer per square meter of support of the recording element.

It is in some cases useful to have an overcoat layer on the electrically activated recording layer according to the invention. It is necessary that the overcoat layer not adversely affect the desired charge sensitivity and ohmic resisitivity properties of the charge sensitive recording element according to the invention. Such an overcoat can reduce fingerprinting and abrasion marks before and after exposure and provide other advantages. The overcoat layer can be one or more of the described polymers which are also useful as binders. These materials must be compatible with other components of the described element according to the invention and must be able to tolerate the processing temperatures employed.

The charge-sensitive recording elements according to the invention can contain addenda which aid in providing a desired image. These addenda can include, for example, development modifiers that function as speed-increasing compounds, hardeners, plasticizers and lubricants, coating aids, brighteners, spectral sensitizing dyes, absorbing and filter dyes, and matting agents. These addenda are described, for example, in the *Product Licensing Index,* Volume 92, December 1971, publication 9232, pages 107–110, published by Industrial Opportunities Ltd., Homewell, Havant Hampshire, P09 1EF, UK.

The charge-sensitive recording element according to the invention can comprise a variety of supports. Typical supports include cellulose ester film, poly(vinyl acetal) film, poly(ethylene terephthalate) film, polycarbonate film and polyester film supports and related films and resinous materials. Other supports are useful such as glass, paper, metal and the like. The support must be able to withstand the processing temperatures employed and not adversely affect the charge sensitive properties and ohmic resistivity which is desired. Typically a flexible support is employed.

The support can be an electrically conducting support such as described in U.S. Pat. No. 4,013,464 of Light, issued Mar. 22, 1977. If the described support is an insulator, the recording element according to the invention must also include an electrically conductive layer positioned between the support and the charge-sensitive layer. The support can contain a semiconductive layer such as a layer containing organic semiconductors or semiconductive compositions containing inorganic materials, such as described in copending U.S. Application Ser. No. 731,861 of Light, filed Oct. 13, 1976, the disclosure of which is incorporated herein by reference.

The described layers of a charge-sensitive recording element as described can be coated on a suitable support by coating procedures known in the photographic art including dip coating, airknife coating, curtain coating or extrusion coating using hoppers such as described in U.S. Pat. No. 2,681,294 of Beguin, issued June 14, 1954. If desired, two or more layers can be coated simultaneously such as described in U.S. Pat. No. 2,761,791 of Russell, issued Sept. 4, 1956 and British Pat. No. 837,095.

The various components of the charge-sensitive materials according to the invention can be prepared for coating by mixing the components with suitable solutions or mixtures including suitable organic solvent solutions depending on the particular charge-sensitive material and the particular components. The components can be added using various procedures known in the photographic art.

The optimum layer thickness of each of the described layers in a charge-sensitive element according to the invention will depend upon such factors as the particular ohmic resistivity desired, charge sensitivity, particular components of the layers, desired image, processing conditions and the like. Especially useful charge-sensitive elements according to the invention can comprise an electrically conductive support having thereon an electrically activated recording layer which has a thickness within the range of about 1 to about 30 microns, typically within the range of about 2 to about 15 microns.

A variety of photoconductors can be useful in the photoconductor layer of the described charge-sensitive recording element. Selection of an optimum photoconductor or combination of photoconductors will depend upon such factors as the particular electrically activated recording layer, the charge sensitivity of the element, the ohmic resistivity desired, exposure means to be used, and the like. It is advantageous to select a photoconductor which has the property of being most useful with the opertive voltages to be used for imaging as well as the impedance of the recording layer as described. For example, it is preferable that the relative impedance of the recording layer and the photoconductor differ by no more than about $10^5$ ohms. The photoconductor can be either an organic photoconductor or an inorganic photoconductor. Combinations of photoconductors can be useful. The resistivity of the photoconductor can change rapidly in the operating voltage range which can be used according to the invention. Examples of useful photoconductors include PbO, CdS, Se and ZnO and organic photoconductors that have the desired characteristics. Useful photoconductors are described, for example, in U.S. Pat. No. 3,577,272 of Reithel, issued May 4, 1971; and "Electrography" by R. M. Schaffert (1975) and "Xerography and Related Processes", by Dessauer and Clark (1965) both published by Focal Press Limited.

An especially useful photoconductor layer in an element according to the invention comprises a dispersion of lead oxide in an insulating binder, such as a binder comprising Lexan (a trademark of General Electric Company, U.S.A., representing a bisphenol A polycarbonate), polystyrene, poly(vinyl butyral) or styrene-butadiene co-polymer (85:15) such as Pliolite S-5 (a trademark of Goodyear).

A recording element according to the invention is especially useful wherein the photoconductor layer is sensitive to X-rays and the conductivity of the described recording layer can be imagewise altered by imagewise exposure of the photoconductive layer to X-ray radiation.

The photoconductor layer can also include a variety of binders and/or sensitizers known in the electrophotographic art. Useful binders are described, for example, in U.S. Pat. No. 2,361,019 of Gerhart, issued Oct. 24, 1944 and U.S. Pat. No. 2,258,423 of Rust, issued Oct. 7, 1941. Sensitizing compounds useful in the photoconductor layer are described in U.S. Pat. No. 3,978,335 of Gibbons, issued Aug. 31, 1976.

The desired resisitivity characteristics of a material according to the invention can be obtained by separately measuring the current-voltage characteristic of each sample coating at room temperature using a mercury contact sample holder to the surface of the coating. To eliminate the possibility that a micro thickness surface air gap might effect the measured resistivity, exposures can be made with an evaporated metal (typically gold or aluminum) electrode on the surface of a charge-sensitive and photoconductor coating to be tested. The resistivity can be measured at various ambient temperatures. The data can be measured at a voltage of, for example, 400 volts or $2\times10^5$ volts per centimeter, which is within the ohmic response range of the layer to be tested. It can be expected that the resistivity of the described recording layer will vary widely with temperature with the largest decrease in resistivity occurring at a particular temperature range above about 20° to 30° C. It can also be expected that the dielectric strength of the layer will vary with temperature. The selection of an optimum temperature accordingly can be determined based on the dielectric strength of the recording layer.

Interlayers can be useful in certain instances in the charge-sensitive recording element as desired. Useful interlayers are described, for example, in U.S. Pat. No. 3,978,335 of Gibbons.

A variety of energy sources can be useful for imagewise exposure of a recording material as described. Selection of an optimum energy source for imagewise exposure will depend upon such factors as the sensitivity of the photoconductor layer, the particular image recording combination in the electrically activated recording layer, the desired image, and the like. Useful energy sources for imagewise exposure include, for example, visible light, X-rays, lasers, electron beams, ultraviolet radiation, infrared radiation, gamma rays, and the like.

One useful embodiment of the invention is a charge-sensitive recording element having an ohmic resistivity of at least about $1\times10^{10}$ ohm-cm comprising, in sequence, a support having thereon (a) a first electrical conducting layer, (b) a photoconductor layer, (c) an electrically activated recording layer comprising an image-forming combination of (i) a silver behenate oxidizing agent, with (ii) a phenolic reducing agent, and (iii) a photographic speed-increasing concentration of an anthraquinone or substituted anthraquinone electron acceptor, in a synthetic polymeric binder and (d) a second electrical conducting layer. In this embodiment it is useful to have a semiconductive layer as the layer (a) on the support. This semiconductive layer can contain organic semiconductors or semiconductor compositions containing inorganic materials, such as described in copending U.S. Application Ser. No. 731,861 of Light, filed Oct. 13, 1976.

As described, the charge-sensitive recording element according to the invention can be a non-silver charge-sensitive recording element. According to this embodiment, the non-silver, charge-sensitive recording element, as described, can comprise an electrically activated recording layer comprising an image-forming combination of (i) a non-silver, organic, heavy metal salt oxidizing agent selected from the group consisting of tellurium (II) coordination complex and organocopper oxidizing agents, and (ii) an organic reducing agent, with (iii) a photographic speed-increasing concentration of a photographic speed-increasing electron acceptor which is a compound selected from the group consisting of the described electron acceptors (I) through (VII) and combination thereof, and a binder.

An especially useful embodiment of the invention is a non-silver, charge-sensitive recording composite element having an ohmic resistivity of at least $1\times10^{10}$ ohm-cm comprising, in sequence, a support having thereon (a) a nickel, electrical conducting layer, (b) a photoconductor layer, (c) a non-silver, electrically activated recording layer comprising an image-forming combination of (i) a tellurium (II) xanthate oxidizing agent, (ii) a sulfonamidophenol reducing agent, (iii) a photographic speed-increasing concentration of an organic photographic speed-increasing electron acceptor which consists essentially of anthraquinone, and a binder, and (d) a second electrical conducting layer comprising a chromium composition.

A variety of processing means can be useful for producing a developed image in a charge-sensitive recording element according to the invention. Typically, the image is provided by the steps of: (a) applying an electric potential imagewise to the described recording element of a magnitude and for a time sufficient to produce in the image areas a charge density within the range of about 0.1 microcoulomb/cm$^2$ to about 1 millicoulomb/cm$^2$, wherein the charge density forms a developable latent image in the recording element; and (b) heating the recording element substantially uniformly at a temperature and for a time sufficient to develop the latent image.

An imagewise current flow is provided through the described electrically activated recording layer. Although a particular technique to produce an imagewise current flow has been described for use in a variety of recording apparatus, the especially useful techniques are those which include use of a photoconductive layer as an image to current converter. The imagewise current flow can be provided, however, by contacting the recording element with a suitable electrostatically charged means such as an electrostatically charged stencil and scanning the recording element with a beam of electrons.

Heating the recording layer after latent image formation can be carried out by techniques and with means known in the photothermographic art, for example, by passing the imagewise exposed recording material over a heated platen or through heated rolls, by heating the element with microwaves, with dielectric heating means and the like. A visible image can be developed in the described exposed material within a short time by the described uniform heating step. An image having a maximum reflection density of at least 1.5 can be provided according to the invention. For example, the exposed element can be uniformly heated to a temperature within the range of about 80° C. to about 180° C. until the latent image is developed, typically within about 1 to about 90 seconds. The imagewise exposed material according to the invention is preferably heated to a temperature within the range of about 85° C. to about 120° C. until the desired image is developed.

One process embodiment of the invention is a dry, electrically activated recording process for producing a developed, silver image in a charge-sensitive recording element having an ohmic resistivity of at least about $1\times10^{10}$ ohm-cm and comprising, in sequence, a support having thereon (a) a first electrical conducting layer, (b) a photoconductive layer, (c) an electrically activated recording layer comprising an image-forming combination of (i) a silver behenate oxidizing agent, with (ii) a phenolic reducing agent, and (iii) a photographic speed-increasing concentration of an anthraquinone or substituted anthraquinone electron acceptor, in a synthetic polymeric binder, and (d) a second conducting layer, comprising (A) imagewise altering the conductivity of the described photoconductor layer with an image (I) to be recorded, and (B) applying an electric potential across the photoconductive and recording layers of a magnitude and for a sufficient time to produce a developable latent image in the layer (c) corresponding to the image (I); and (C) heating the recording layer substantially uniformly at a temperature and for a time sufficient to develop the latent image. Typically, the recording element is heated in (C) to a temperature within the range of about 80° C. to 180° C.

Another embodiment of a process as described is a dry electrically activated recording process for producing a developed, heavy metal image in a charge-sensitive recording element having an ohmic resistivity of at least about $1\times10^{10}$ ohm-cm and comprising an electrically activated recording combination comprising (i) an organic, heavy metal salt oxidizing agent, with (ii) an organic reducing agent, and (iii) a photographic speed-increasing concentration of a photographic speed-increasing electron acceptor as described herein and a binder; comprising, in sequence, the steps of: (a) positioning the recording element in face-to-face contact with a photoconductive element; (b) imagewise exposing the photoconductive element to actinic radiation while simultaneously applying an electrical potential having a field strength of at least about $1\times10^5$ volts per centimeter across the photoconductive and recording element composite for a sufficient time to provide a developable latent image in the areas of the recording element corresponding to the imagewise exposed areas of the photoconductive element; and (c) uniformly heating the recording element at a temperature and for a time sufficient to develop the latent image. Preferably, the impedance of the recording element differs from the impedance of the photoconductive element by no more than $10^5$ ohm-cm when the latent image-forming electrical potential is applied across the photoconductive and recording element.

While the exact mechanism of image formation upon heating is not fully understood, it is believed that the imagewise exposure to charge provides developable nuclei in the described recording layer in the image areas. It is believed that the nuclei formed in the image areas increase the reaction rate and act as catalysts for the reaction between the heavy metal salt oxidizing agent and the reducing agent. It is believed that the nuclei enable a form of amplification which would not otherwise be possible. The described organic, heavy metal salt oxidizing agent and the reducing agent must be in a location with respect to each other which enables the nuclei to provide the desired catalytic effect. The described organic, heavy metal salt oxidizing agent and the reducing agent are in this sense in reactive association in the electrically activated recording layer. The term "in reactive association" is intended to mean that the nuclei resulting from the imagewise exposure are in a location with respect to the described organic, heavy metal salt oxidizing agent and the reducing agent which enables this desired catalytic activity, desired lower processing temperature and provides a more useful developed image.

Figure 2:
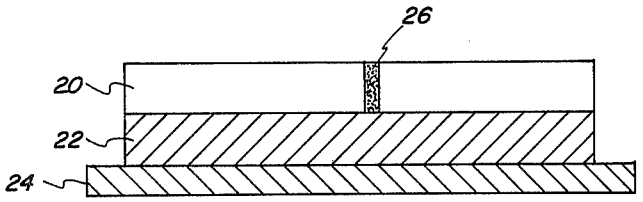

Referring to the drawings, in particular to FIGS. 1 and 2, these illustrate embodiments of the invention depicted schematically. According to the embodiment illustrated in FIGS. 1 and 2, a charge-sensitive, recording layer 10 is placed upon a grounded electrically conductive backing or support 12. A current is selectively applied to the recording layer 10 by the point of a metal stylus 14 which is raised to a sufficiently high voltage relative to the support 12 by a voltage source 16, and brought into moving contact with the exposed surface of the recording layer 10 containing the image-forming combination including the desired speed-increasing electron acceptor. Upon contacting the recording layer 10 with the stylus 14, a current flow is produced in the areas of the recording layer contacted by the stylus and forms a developable latent image, that is a pattern of nuclei sites, in the pattern desired. The charge density produced by the stylus in the contacted areas of the recording layer need not be sufficient to produce a visible image in the recording layer 10; however, the charge density must be sufficient to produce a latent image in the recording layer in those areas contacted by the stylus. Although a particular technique to produce an imagewise current flow through the recording layer 10 has been described, techniques generally known in the art of recording can be useful and are intended to be encompassed by the description. The area of the recording layer 10 designated as 18 is intended to be illustrative of an area of nuclei sites formed upon contact of the stylus 14 with the recording layer 10. Other techniques for producing a nuclei pattern include, for example, contacting the recording layer 10 with an electrostatically charged stencil or scanning the layer 10 with a beam of electrons in an image pattern.

FIG. 2 illustrates development of the latent image formed in the recording element in FIG. 1 by, for example, moving the element from FIG. 1 into contact with a heated metal platen 24. The heat from platen 24 passes through the support 22 to the layer 20 containing the latent image to cause the desired reaction in the latent image area. The reaction in the latent image area causes development to produce a visible image 26 in the recording layer 20. Upon development, the recording element is removed from the heated platen 24. No processing solutions or baths are required in this heat development step.

Figure 3:
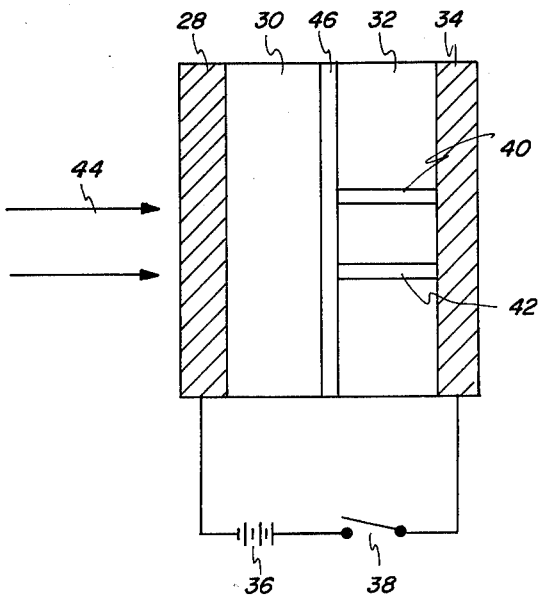

Another illustrative embodiment of the invention is schematically shown in FIGS. 3 and 4. In this embodiment, in FIG. 3, the developable nuclei sites 40 and 42, that is the latent image, are formed by sandwiching a charge-sensitive, resistive recording layer 32 and an image to current converter 30, preferably a photoconductive layer, between a pair of electrically conductive layers 28 and 34, respectively. A high potential electric field is established across the photoconductive and recording layers by connecting the conductive layers 28 and 34 by connecting means 36. The electric field across the layers is controlled by switch 38. Latent image formation at latent image sites 40 and 42 is caused by imagewise exposing the photoconductive layer 30 through the transparent conductor 28 to exposure means 44, typically actinic radiation. The exposure selectively increases the conductivity of the conductive layer in those regions exposed to actinic radiation. When switch 38 is closed, thereby establishing an electric field across the layer, an imagewise current flow is produced through the recording layer 32. The current flow occurs in those regions of the recording layer 32 only in position with the exposed portions of the photoconductive layer 30. It is especially useful in this embodiment to provide a small air gap 46 between layers 30 and 32. This provides for an improved image in the recording layer 32. After a charge density of less than 1 millicoulomb/cm$^2$, preferably about 0.1 microcoulomb/cm$^2$, has been produced in the current exposed portions of the recording layer 32, switch 32, switch 38 is opened, thereby disrupting the current flow. The described technique for the application of voltage across the photoconductive and recording layers is illustrative. A variety of techniques known in the recording art can be useful and are intended to be included in this description. For example, a grid controlled corona discharge means can be substituted for the voltage source and conducting layer 28 of the recording element.

To develop the latent image sites 40 and 42, the recording element is moved away from the photoconductive layer. Connecting means 36 is also disconnected. The recording element illustrated in FIG. 4 is then contacted with a heated platen 52 illustrated in FIG. 4.

The heat from the platen 52 passes through the support 50 and the layer 48 containing the speed-increasing electron acceptor according to the invention to provide a developed image 54. The heating is preferably carried out substantially uniformly by merely positioning the recording element in heat transfer relationship with the heated platen 52. After the development of the latent image sites, the recording element is removed from the platen.

The resistivity of the recording layer or layers useful according to the invention may be effected by exposure history, the direction of the applied field, and when sandwiched with a photoconductor, by air gap affects and photoconductor affects. The number of variables affecting the resistance of the recording layers useful according to the invention, coupled with their non-ohmic behavior at higher applied fields, can affect the choice of an optimum recording material and imaging means. The resistivity values as described herein for particular charge-sensitive recording materials are therefore values measured under temperature and voltage conditions which produce desired ohmic behavior.

If desired, the recording element and means according to the invention can be readily modified to provide a continuous image recording operation. This can be carried out using desired control circuitry and continuous transport apparatus.

In the embodiments illustrated which use an air gap between the photoconductor and image recording layers, the air gap distances are typically controlled by the roughness of the surface of the photoconductor layer as well as the image recording layer. Although the air gap need not be uniform, it can be, for example, within the range of about 1 to about 10 microns thickness. For example, the distances shown in FIG. 3 between photoconductor layer 30 and recording layer 32 can be within the range of about 1 to about 10 microns as illustrated by air gap 46.

The following examples are included for a further understanding of the invention.

Example 1

This is a comparative example.

An imaging composition was prepared by mixing the following components:

| | |
|---|---|
| silver behenate | 4.2 g |
| behenic acid | 2.3 g |
| 1(2H)-phthalazinone | 1.0 g |
| poly(vinyl butyral) (binder) (BUTVAR B-76, trade name of Monsanto Chemical Co., U.S.A.) (in 1:1, acetone:toluene) (5% by weight) | 30.0 g |

The resulting composition was ballmilled for 24 hours in a 120 cc jar with small gate balls. The following composition was then added, with stirring, to the composition containing silver behenate:

| | |
|---|---|
| 2,2'-methylenebis(6-tert-butyl-4-methylphenol) | 3.0 g |
| poly(vinyl butyral) (binder) (BUTVAR B-76, as described) (5% by weight) (in 1:1 acetone:toluene) | 20.0 g |
| mercuric chloride | 0.01 g |

The resulting composition was coated at a 3 mil wet coating thickness on a Baryta coated paper support. This coating (I) was permitted to dry and then overcoated at a 2 mil wet coating thickness with a 1.0% by weight solution of cellulose triacetate in a 9:1 mixture of methylene chloride with methanol. The resulting imaging element was used as a control in a charge-sensitive recording arrangement as shown in FIG. 5 in the drawings. The charge-sensitive recording arrangement consisted of, in sequence, an electrically conducting metal platen 52 having thereon, respectively, the paper support 54 having the imaging layer 56 containing silver behenate. An air gap 58 about 7 μm thick was present between overcoat layer 57 on imaging layer 56 and a lead monoxide photoconductor layer 60. The layer 60 was on a nickel, electrical conducting layer 62 which was on a transparent, poly(ethyleneterephthalate) film support 64. Developable nuclei were formed in imaging layer 56 by imagewise exposure with a tungsten light source (3000° K. tungsten light bulb) through step tablet 66. At the time of imagewise exposure with the tungsten light source, a high potential electric field was established across the photoconductive and image recording layers by connecting the conductive layer 62 and the metal platen 52 through a power source 68. The electric field across the layers was controlled by switch 70. After the necessary charge density is established, switch 70 was opened, thereby disrupting the current flow. Imagewise exposure was for 40 seconds at 14.5 foot candles. A 0.3 density step wedge was used for imagewise exposure purposes. To develop the resulting latent image, layer 56 was moved away from the photoconductive layer 60. The recording layer 56 was then heated by contacting it with a heated metal platen, not shown, for 30 seconds at 85° C. The developed image had a maximum reflection density of 1.7 and a minimum density of 0.1

Example 2

This illustrates the invention.

An imaging composition and charge-sensitive recording element were prepared as described in Example 1 with the exception that the image-recording layer contained 0.05 moles of anthraquinone per mole of silver behenate in the recording layer. Also, the imagewise exposure was for 40 seconds at 5.1 foot candles. The imagewise exposed recording layer was heated for 30 seconds at 100° C.

The resulting developed image has a relative speed which was about two times greater than that of the developed image from Example 1.

Example 3

The procedure described in Example 1 was repeated with the exception that the recording layer contained 0.02 moles of tetrachlorophthalic anhydride per mole of silver behenate in the recording layer. Also, the imagewise exposure was for 40 seconds at 14.5 foot candles. The exposed recording layer was heated for 30 seconds at 95° C. to provide a developed image. The developed image had a maximum density of about 1.9 with a minimum density of about 0.2.

The resulting developed image had a relative speed which was significantly higher than a corresponding element containing no tetrachlorophthalic anhydride.

Increased speed was observed with similar elements as described in Example 1 containing about 0.02 to about 0.06 moles per mole of silver behenate of each of the following speed-increasing electron acceptors:

Example 4—p-benzoquinone

Example 5—p-chloranil

Example 6—α,α,α,α′,α′,α′-hexachloro-p-xylene

Example 7—2,4,5,6-tetrachloropyrimidine

Example 8—,2,3,6-trichloroquinoxaline

Example 9—-tetrachlorophthalonitrile

Example 10—-phthalaldehyde

Example 11—-cobaltihexamine trifluoroacetate

Example 12

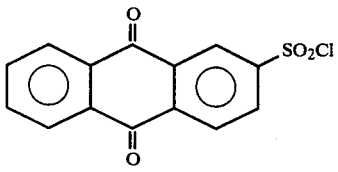

Example 13

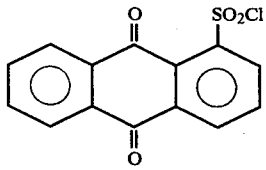

Example 14

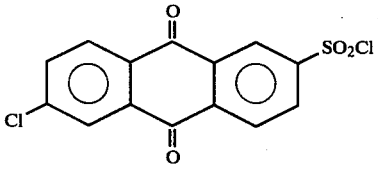

Example 15

This is a comparative example.

The procedure described in Example 1 was repeated with the exception that 0.03 moles of hexamethylbenzene was added per mole of silver behenate in the described image recording layer. Upon processing no significant increase in relative speed was observed in the imaging layer.

Example 16

This is a comparative example.

The procedure described in Example 1 was repeated with the exception that 0.03 moles of biphenyl was added to the image recording layer per mole of silver behenate in the described layer. No significant increase in relative speed was observed for the developed image upon processing.

Example 17

This is a comparative example.

The procedure described in Example 1 was repeated with the exception that zinc chloride at a concentration of 0.03 moles of zinc chloride per mole of silver behenate was added to the image recording layer. No significant increase in relative speed was observed with the described image recording material.

The invention has been described in detail with particular reference to preferred embodiments thereof, but it will be understood that variations and modifications can be effected within the spirit and scope of the invention.

What is claimed is:

1. A dry electrically activated recording process for producing a developed, silver image in a charge-sensitive recording element having an ohmic resistivity of at least about $1\times10^{10}$ ohm-cm and containing at least one electrically activated recording, image-forming combination comprising (i) an organic, silver salt oxidizing agent with (ii) an organic reducing agent, and (iii) a photographic speed-increasing concentration of an organic photographic speed-increasing electron acceptor which is a compound selected from the group consisting of (I) anthraquinone, and substituted anthraquinone electron acceptors, (II) phthalaldehyde, (III) tetrachlorophthalonitrile, (IV) tetrachlorophthalic anhydride, (V) p-chloranil, (VI) α,α,α,α′,α′,α′-hexachloro-p-xylene, (VII) cobaltihexamine trifluoroacetate, and combinations thereof, and a binder; said process comprising the steps of (A) imagewise applying an electric potential across said recording layer of a magnitude and for a sufficient time to produce a developable latent image in said layer corresponding to said image (I); and (B) heating said recording layer substantially uniformly at a temperature and for a time sufficient to develop said latent image.

2. A process as in claim 1 wherein said recording element is heated in (B) to a temperature within the range of about 80° C. to about 180° C. until said latent image is developed.

3. A dry electrically activated recording process for producing a developed, silver image in a charge-sensitive recording element having an ohmic resistivity of at least about $1\times10^{10}$ ohm-cm and comprising, in sequence, a support having theron (a) a first electrical conducting layer, (b) a photoconductor layer, (c) an electrically activated recording layer comprising in a binder an image-forming combination of (i) an organic, heavy metal salt oxidizing agent, with (ii) an organic reducing agent, and (iii) a photographic speed-increasing concentration of an organic photographic speed-increasing electron acceptor which is a compound selected from the group consisting of (I) anthraquinone and substituted anthraquinone electron acceptors, (II) phthalaldehyde, (III) tetrachlorophthalonitrile, (IV) tetrachlorophthalic anhydride, (V) p-chloranil, (VI) α,α,α,α′,α′,α′-hexachloro-p-xylene, (VII) cobaltihexamine trifluoroacetate, and combinations thereof, and a binder, and (d) a second electrical conducting layer; said process comprising the steps of (A) imagewise altering the conductivity of said photoconductor layer in accord with an image (1) to be recorded;

(B) applying an electric potential across said photoconductive and recording layers of a magnitude and for a sufficient time to produce a developable latent image in said layer corresponding to said image (1); and (C) heating said recording layer substantially uniformly at a temperature and for a time sufficient to develop said latent image.

4. A process as in claim 3 wherein said recording element is heated in (C) to a temperature within the range of about 80° C. to about 180° C. until said latent image is developed.

5. A dry electrically activated recording process for producing a developed, silver image in a charge-sensitive recording element having an ohmic resistivity of at least about $1\times$ $^{10}$ ohm-cm and comprising, in sequence, a support having thereon (a) a first electrical conducting layer, (b) a photoconductive layer, (c) an electrically activated recording layer comprising an image-forming combination of (i) a silver behenate oxidizing agent, with (ii) a phenolic reducing agent, and (iii) a photographic speed-increasing concentration of an anthraquinone or substituted anthraquinone electron acceptor, in a synthetic polymeric binder, and (d) a second conducting layer, comprising (A) imagewise altering the conductivity of said photoconductor layer in accord with an image (I) to be recorded, and (B) applying an electric potential across said photoconductive and recording layers of a magnitude and for a sufficient time to produce a developable latent image in said layer corresponding to said image (I); and (C) heating said recording layer substantially uniformly at a temperature and for a time sufficient to develop said latent image.

6. A dry electrically activated recording process as in claim 5 wherein said recording element is heated in (C) to a temperature within the range of about 80° C. to about 180° C.

7. A dry electrically activated recording process for producing a developed heavy metal image in an electrically activated recording element comprising, in sequence, the steps of (a) imagewise altering the conuctivity of a photoconductive layer (I) in accord with an image that is to be recorded, (b) positioning the imagewise altered photoconductive layer (I) from (a) adjacent an electrically activated recording layer (II) of said recording element comprising at least one electrically activated recording, image-forming combination of (i) an organic heavy metal salt oxidizing agent, with (ii) an organic reducing agent, and (iii) a photographic speed-increasing electron acceptor which is a compound selected from the group consisting of (I) anthraquinone and substituted anthraquinone electron acceptors, (II) phthalaldehyde, (III) tetrachlorophthalonitrile, (IV) tetrachlorophthalic anhydride, (V) p-chloranil, (VI) $\alpha,\alpha,\alpha,\alpha',\alpha',\alpha'$-hexachloro-p-xylene, (VII) cobaltihexamine trifluoroacetate, and combinations thereof, and a binder; said recording layer having an ohmic resistivity of at least about $1\times$ $^{10}$ ohm-cm;

(c) applying an electric potential across said photoconductive and recording layers of a magnitude and for a sufficient period of time to produce in the areas of said recording layer corresponding to the imagewise altered portions of said photoconductive layer a charge density within the range of about 0.1 microcoulomb/cm$^2$ to about 1 millicoulomb/cm$^2$, said charge density forming in said areas a developable latent image; and (d) uniformly heating the recording element at a temperature and for a time sufficient to develop said latent image.

8. A dry electrically activated recording process as in claim 7 wherein said oxidizing agent consists essentially of a silver behenate oxidizing agent, said reducing agent consists essentially of a compound selected from the group consisting of 3-pyrazolidone, phenolic, reductone, and sulfonamidophenol reducing agents, and said speed-increasing electron acceptor consists essentially of anthraquinone.

9. A dry electrically activated recording process for producing a developed, heavy metal image in a charge-sensitive recording element having an ohmic resistivity of at least about $1\times10^{10}$ ohm-cm and comprising an electrically activated recording combination comprising (i) an organic heavy metal salt oxidizing agent, with (ii) an organic reducing agent, and (iii) a photographic speed-increasing electron acceptor which is a compound selected from the group consisting of (I) anthraquinone and substituted anthraquinone electron acceptors, (II) phthalaldehyde, (III) tetrachlorophthalonitrile, (IV) tetrachlorophthalic anhydride, (V) p-chloranil, (VI) $\alpha,\alpha,\alpha,\alpha',\alpha',\alpha'$-hexachloro-p-xylene, (VII) cobaltihexamine trifluoroacetate, and combinations thereof, and a binder; comprising, in sequence, the steps of:

(a) positioning said recording element in face-to-face contact with a photoconductive element;

(b) imagewise exposing said photoconductive element to actinic radiation while simultaneously applying an electrical potential having a field strength of at least about $1\times10^5$ volts/cm across said photoconductive and recording element composite for a sufficient time to provide a developable latent image in the areas of said recording element corresponding to the imagewise exposed areas of said photoconductive element; and (c) uniformly heating the recording element at a temperature and for a time sufficient to develop said latent image.

10. A dry electrically activated recording process as in claim 9 wherein said oxidizing agent consists essentially of a silver behenate oxidizing agent, said reducing agent consists essentially of a compound selected from the group consisting of 3-pyrazolidone, phenolic, reductone, and sulfonamidophenol reducing agents, and said speed-increasing electron acceptor consists essentially of anthraquinone.

11. A process as in claim 9 wherein the impedance of said recording element differs from the impedance of said photoconductive element by no more than $10^5$ ohm-cm when said latent image-forming electrical potential is applied across said photoconductive and recording elements.

12. A process as in claim 9 wherein said photoconductive element is X-ray sensitive and the conductivity of said element is imagewise altered by imagewise exposing said photoconductive element to X-ray radiation in accord with the image to be recorded.

13. A process as in claim 9 wherein said oxidizing agent is an organotellurim (II) compound.

14. A process as in claim 9 wherein said oxidizing agent is a tellurium (II) xanthate.

15. A dry, non-silver, electrically activated recording process for producing a developed, heavy metal image in a charge-sensitive recording element having an ohmic resistivity of at least about $1\times10^{10}$ ohm-cm and containing at least one electrically activated recording image-forming combination comprising (i) a non-silver, organic heavy metal salt oxidizing agent, with (ii) an organic reducing agent, and (iii) a photographic speed-increasing concentration of an organic photographic speed-increasing electron acceptor which is compound selected from the group consisting of (I) anthraquinone and substituted anthraquinone electron acceptors, (II) phthalaldehyde, (III) tetrachlorophthalonitrile, (IV) tetrachlorophthalic anhydride, (V) p-chloranil, (VI) $\alpha,\alpha,\alpha,\alpha',\alpha',\alpha'$-hexachloro-p-xylene, (VII) cobaltihexamine trifluoroacetate, and combinations thereof, and a binder;

said process comprising the steps of:

(a) applying an electric potential imagewise to said recording element of a magnitude and for a sufficient time to produce in the image areas a charge density within the range of about 0.1 microcoulomb per $cm^2$ to about 1 millicoulomb per $cm^2$, said charge density forming a developable latent image in the recording element; and (b) heating said exposed recording element substantially uniformly at a temperature and for a time sufficient to develop said latent image.

16. A dry, non-silver, electrically activated recording process as in claim 15 wherein said oxidizing agent is an organometallic compound selected from the group consisting of organotellurium (II) compounds and organocopper compounds.

* * * * *

UNITED STATES PATENT AND TRADEMARK OFFICE

CERTIFICATE OF CORRECTION

PATENT NO. : 4,201,583

DATED : May 6, 1980

INVENTOR(S) : Raymond F. Reithel

It is certified that error appears in the above-identified patent and that said Letters Patent are hereby corrected as shown below:

Column 7, lines 8-9, "saltoxidizing" should read ---salt oxidizing---; line 14, "agents" should read ---agent---; line 61, "1-pheyl-" should read --- 1-phenyl ---.

Column 8, line 13, "thedesired" should read ---the desired---; lines 15-16, "combinaton" should read ---combination---; line 21, "1.Omole" should read ---1.0 mole---; line 25, "As" should read ---An---.

Column 9, line 5, "Ltds." should read ---Ltd.---; line 17, "tha" should read ---than---; line 45, a "," should be inserted after "image"; line 55, "emloyed" should read ---employed---; lines 57-58, "combinaton" should read ---combination---; line 60, "combinaton" should read ---combination---.

Column 10, line 5, a "," should be inserted after "polymer".

Column 12, line 8, "opertive" should read ---operative---.

Column 13, line 50, "combination" should read ---combinations---.

UNITED STATES PATENT AND TRADEMARK OFFICE

CERTIFICATE OF CORRECTION

PATENT NO. : 4,201,583

DATED : May 6, 1980

INVENTOR(S) : Raymond F. Reithel

It is certified that error appears in the above-identified patent and that said Letters Patent are hereby corrected as shown below:

Column 1, line 58, "handeable" should read ---handleable---; line 66, "handeable" should read ---handleable---.

Column 2, line 1, "time" should read ---times---.

Column 3, line 35, a "," should be inserted before "(II)"; lines 56-57, "electrical" should read ---electric---.

Column 4, lines 40-41, "DETAILED DESCRIPTION OF THE INVENTION" should be centered on line 41 as a title; line 54, a "," should be inserted after "organic".

Column 6, line 32, "of which" should read ---to which---; line 34, "sources" should read ---source---; line 37, "in" should read ---for---; line 49, "sterarate" should read ---stearate---.

UNITED STATES PATENT AND TRADEMARK OFFICE

CERTIFICATE OF CORRECTION

PATENT NO. : 4,201,583

DATED : May 6, 1980

INVENTOR(S) : Raymond F. Reithel

It is certified that error appears in the above-identified patent and that said Letters Patent are hereby corrected as shown below:

Column 16, line 54, delete "switch 32,".

Column 17, line 57, "gate" should read ---agate---.

Column 21, line 24, "1 x $^{10}$" should read ---1 x $10^{10}$---; line 57, "conuctivity" should read ---conductivity---.

Column 22, line 11, "1 x $^{10}$" should read ---1 x $10^{10}$---.

Signed and Sealed this

Ninth Day of December 1980

[SEAL]

Attest:

SIDNEY A. DIAMOND

Attesting Officer

Commissioner of Patents and Trademarks